US008850628B2

(12) United States Patent
Faredon

(10) Patent No.: US 8,850,628 B2
(45) Date of Patent: Oct. 7, 2014

(54) PRESSURE RELIEF DEVICE

(76) Inventor: Hager H. S. A. Faredon, Dasman (KW)

( * ) Notice: Subject to any disclaimer, the term of this patent is extended or adjusted under 35 U.S.C. 154(b) by 412 days.

(21) Appl. No.: 13/251,377

(22) Filed: Oct. 3, 2011

(65) Prior Publication Data

US 2013/0081717 A1 Apr. 4, 2013

(51) Int. Cl.
*E03D 9/04* (2006.01)
*E03C 1/122* (2006.01)

(52) U.S. Cl.
CPC ..... *E03C 1/1225* (2013.01)
USPC ..... 4/211; 4/219

(58) Field of Classification Search
CPC ..... E03C 1/244; F16K 24/02; F16K 24/04; E03F 5/041; E03F 5/042
USPC ..... 4/211, 219; 251/324; 137/433, 561 R
See application file for complete search history.

(56) References Cited

U.S. PATENT DOCUMENTS 576,790 A 2/1897 O'Brien
1,835,447 A * 12/1931 Alland ..... 4/287
2,376,729 A * 5/1945 Sherburne ..... 4/680
2,531,721 A 11/1950 Brock
3,315,279 A * 4/1967 Nolan ..... 4/687
3,665,526 A 5/1972 Hoffman
3,671,982 A 6/1972 Sayles
4,744,110 A 5/1988 Ippoliti
4,936,338 A 6/1990 Fonoimoana
5,209,257 A 5/1993 Baker, Jr.
D368,514 S * 4/1996 Crepeau et al. ..... D23/261
8,409,433 B2 * 4/2013 Worth et al. ..... 210/163
2009/0025128 A1 * 1/2009 Chong et al. ..... 4/292

* cited by examiner

*Primary Examiner* — John K Fristoe, Jr.
*Assistant Examiner* — Marina Tietjen
(74) *Attorney, Agent, or Firm* — Lowe Hauptman & Ham, LLP

(57) ABSTRACT

A pressure release device for preventing pressure build-up in a sink, shower or tub drain includes an elongated tubular member having an elongated passageway extending therethrough. A partially closed top with a plurality of openings therein and an open bottom and means for disposing the device in a drain with an upper portion of the device extending upwardly by at least about 1 cm above an opening to the drain and a bottom of the device extends downwardly in the drain at least 1 and preferably about 2 cm below the opening of the drain.

4 Claims, 2 Drawing Sheets

PRESSURE RELIEF DEVICE

FIELD OF THE INVENTION

This invention relates to a pressure relief device and more particularly to a pressure relief device for releasing pressure in and reducing smell from a drain for a sink, shower or tub.

BACKGROUND FOR THE INVENTION

Gravity waste water disposal systems are well known and have been in use for many years. For example, a U.S. Pat. No. 2,531,721 of Brock discloses a drain attachment that prevents water from backing upwardly through a drain trap and into an area to be drained. The Brock attachment features an externally screw threaded body that is adapted to be threaded into the upper end of a drain trap. The body has a concentric chamber opening outwardly through its lower end and an annular row of parallel drainage openings extending therethrough and communicating with the chamber. A float is suspended from the body and moveable longitudinally with relation thereto on the side adjacent to the chamber. In addition, the ceiling chamber on the float is provided for closing the open end of the chamber when the float is advanced toward the body.

A floating drain seal apparatus is disclosed in a U.S. patent of Fonoimoana, U.S. Pat. No. 4,936,338. As disclosed, a floating drain seal is utilized in combination with a drain formed with a conical bottom surface and a coaxially aligned outlet pipe. A float plug with a complementary conical bottom surface is spaced from the bottom surface of the drain to effect of drainage water therebetween. The float includes a planar top surface cooperative with an annular tubular seal coaxially spaced exteriorly of a circular matrix of openings. The float includes a hemispherical depression formed coaxially into its top surface to receive a hemispherical bottom portion of a seal coaxially aligned with the drain to effect sealing of the drain when a plugged or slowed drain condition backs up drainage water therethrough.

Finally, a sewer relief valve is disclosed in a U.S. patent of Baker, Jr., U.S. Pat. No. 5,209,257. As disclosed, a vent for relieving pressure in a sewage collection system for building characterized by a buoyant float-closure which will easily open in response to fluid pressure to permit escape of gas or liquid from the system upon the build-up in the system of minimum pressure in excess of atmospheric pressure. The float closure is mounted in a threaded plug which is adapted to replace the conventional clean-out plug on the exterior of the building.

Notwithstanding the above it is presently believed that there is a need and a potential commercial market for an improved pressure relief device for releasing pressure in a drain for a sink, shower or tub in accordance with the present invention. There should be a demand for such devices because they are relatively small and relatively easy to install in a drain, easy to remove from a drain and of rugged construction. In addition such devices can be manufactured and sold at a competitive price and are readily manufactured from a readily accessible plastic.

BRIEF SUMMARY OF THE INVENTION

A sewer relief device for preventing pressure build-up in a sink, shower or tub drain comprises or consists of an elongated tubular member having an elongated passageway extending therethrough. An essentially closed top with a plurality of openings therein and an open bottom portion are provided together with means for disposing the device in a drain with an upper portion of the device extending upwardly by at least one centimeter above an opening to the drain. Further, the bottom of the device extends downwardly within the drain at least one centimeter and preferably two centimeters below the opening of the drain.

In a preferred embodiment of the invention the elongated tubular member includes an inner element and a coaxially disposed outer shell each of which are made of polyvinyl chloride and wherein the inner member includes a closed upper end with a plurality of openings extending therethrough and includes an elongated passageway. The inner member also includes a shoulder so that when the outer shell is assembled with the inner member, the top portion of the outer shell abuts against the shoulder of the inner member.

The invention will now be described in connection with the accompanying drawings wherein like reference numerals have been used to indicate like parts.

DESCRIPTION OF THE PREFERRED EMBODIMENTS OF THE INVENTION

Figure 1:
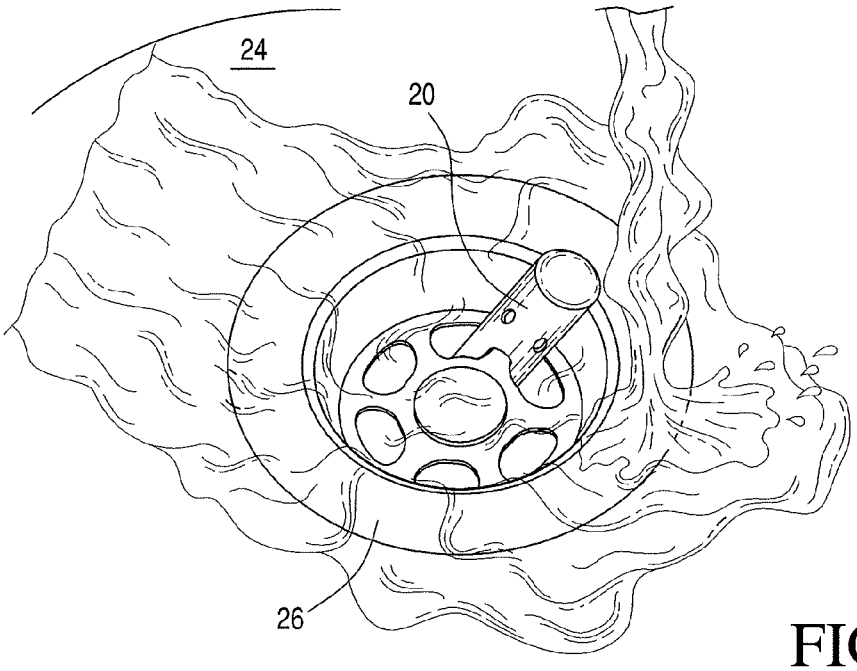
FIG. 1 is a perspective view of a sink and drain with a pressure relief device in accordance with the present invention disposed in the drain.
Figure 2:
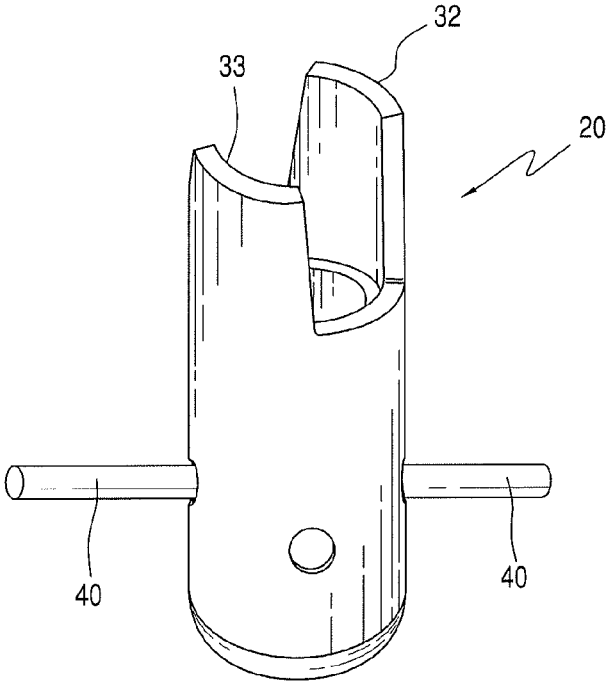
FIG. 2 is a perspective view taken from the bottom of a pressure relief device in accordance with a preferred embodiment of the invention.
Figure 3:
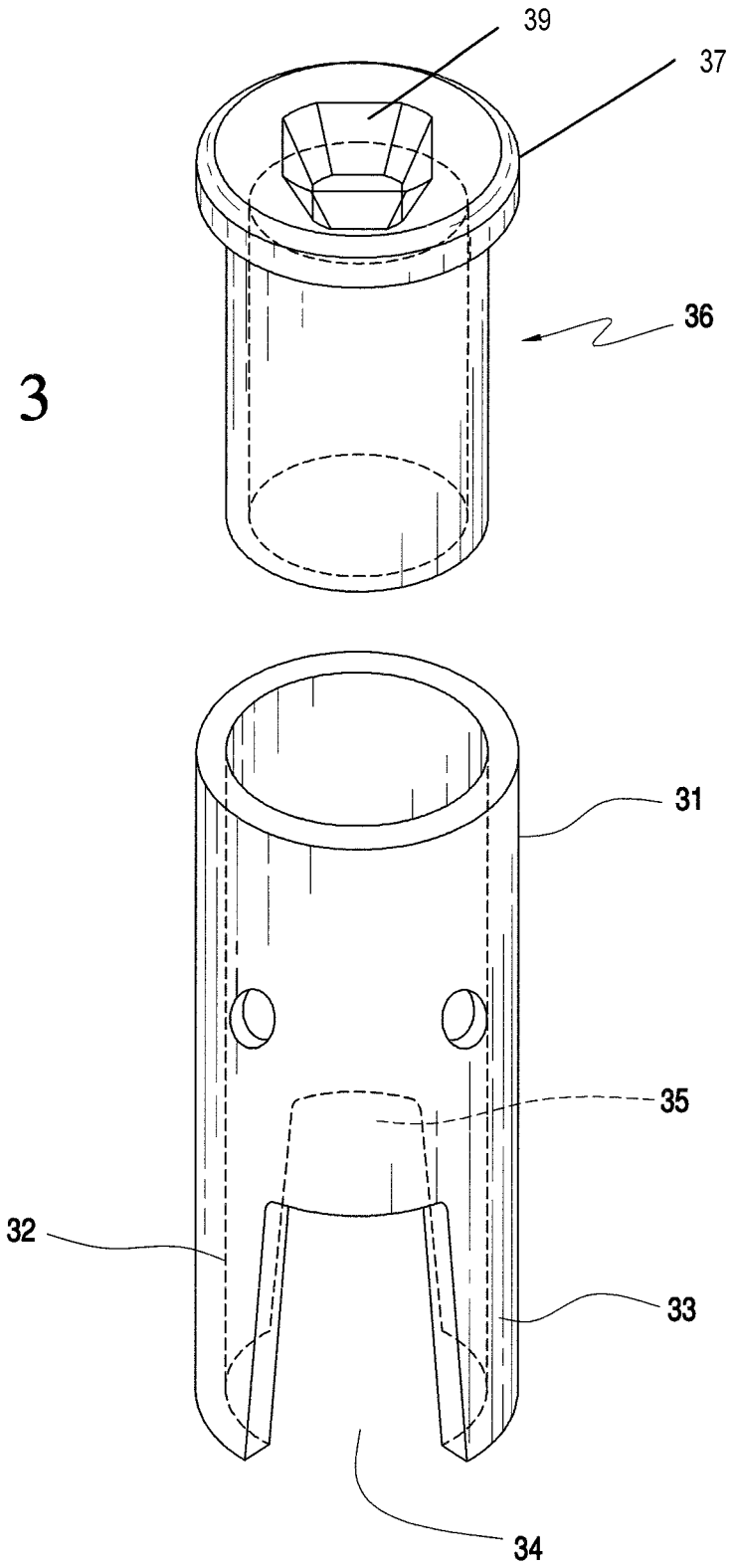
FIG. 3 is an exploded view of the pressure relief device shown in FIG. 2.

As shown in FIGS. 1-3, a pressure relief device 20 is disposed in a drain 26 with water partially filling a bowl or sink 24. As shown, a mass of water is partially filling the sink 24 and the pressure relief device 20 is extending upwardly above the surface of the water.

In a preferred embodiment of the invention, the pressure relief device 20 has a generally cylindrical shape that is disposed in the entrance of a drain 26. The device 20 in accordance with a preferred embodiment of the invention has a length of between about 2 and 3 centimeters and a width or diameter of about 1 cm to 1½ cms. The device 20 is disposed in an opening to the drain so that the top of the device extends upwardly above the drain and accumulated water. A bottom portion that extends downwardly into a generally vertically drain.

As shown in FIGS. 2 and 3, the pressure release device 20 includes an outer plastic shell 31 that is made of polyethylene terephthalate or polyvinyl chloride or the like. In the preferred embodiment of the invention the device is made of a relatively ridged plastic. In one embodiment of the invention the polyethylene terephthalate is of the type used in manufacturing wine bottles.

As shown, the pressure relief device 20 includes an outer plastic shell 31 that defines a right circular cylinder that extends downwardly into a drain by at least 1 to about 2½ cm and an upper portion that extends above the surface of running water in a sink 24 or the like. The outer plastic sleeve defines a pair of downwardly extending leg portions 32 and 33 that are separated by two opposite generally U-shaped openings 34 and 35.

The device 20 in accordance with the preferred embodiment of the invention also includes a coaxial inner member 36 having a right circular cylindrical shape with a generally closed dome shaped upper end 37 having a plurality of relatively small openings 39 that extend through the generally closed upper end and into an elongated passageway of the inner member. The inner member 36 is snugly fit into the outer plastic shell and is preferably made from the same plastic as the outer shell 31 and extends downwardly to the top of the leg portions 32 and 33. In the preferred embodiment of the invention, the upper portion of the device extends upwardly above the opening in the drain by about 1 cm.

Means such as a stainless steel or chrome plated metal rod 40 extends through the device 20 perpendicular to the longitudinal axis of the device to position the device 20 at the opening of a drain. This rod 40 is disposed about 1 cm below the top of the device 20 and 1 to 2 cm above the bottom of the leg portions 32 and 33 so that the device does not tip over within a drain of about 1 to 2 inches. (2.54 to 5.08 cms) diameter.

While the invention has been described in connection with its preferred embodiments it should be recognized that changes and modifications may be made therein without departing from the scope of the appended claims.

What is claimed is:

1. A pressure relief device for preventing pressure buildup in a sink, shower or tub drain, said device consisting of:

an elongated tubular member having an elongated passageway extending therethrough;

a substantially closed top with a plurality of relatively narrow openings therein and an open bottom wherein said elongated tubular member is made of polyethylene terephthalate;

a metal rod passing through an upper portion of said tubular member and having a length longer than the diameter of the drain for positioning the top of said member above said drain and the bottom of said tubular member extending down into the drain and in which said tubular member has a length from top to bottom of at least about 2 cm and a width of about 1 cm.

2. A pressure relief device for preventing pressure buildup in a sink, shower or tub drain according to claim 1 in which said elongated tubular member includes an inner element and a coaxial outer shell each of which are made of polyvinyl chloride and wherein said inner member includes a partially closed portion with a plurality of openings extending therethrough and into an elongated pathway and further including a shoulder and wherein said outer shell includes a circular upper shell that abuts said outer shoulder of said inner member.

3. A pressure relief device for preventing pressure buildup in a sink, shower or tub drain according to claim 2 in which said means is a chrome plated metal rod.

4. A pressure relief device for preventing pressure buildup in a sink, shower or tub drain according to claim 2 in which said means is a stainless steel rod.

* * * * *